United States Patent [19]

Kuwata et al.

[11] Patent Number: 4,613,546

[45] Date of Patent: Sep. 23, 1986

[54] THIN-FILM ELECTROLUMINESCENT ELEMENT

[75] Inventors: Jun Kuwata, Hirakata; Tomizo Matsuoka, Neyagawa; Yosuke Fujita, Ashiya; Atsushi Abe, Ikoma; Tsuneharu Nitta, Katano, all of Japan

[73] Assignee: Matsushita Electric Industrial Co., Ltd., Osaka, Japan

[21] Appl. No.: 678,406

[22] Filed: Dec. 5, 1984

[30] Foreign Application Priority Data

Dec. 9, 1983 [JP] Japan ..... 58-233015

[51] Int. Cl.[4] ..... H05B 33/22

[52] U.S. Cl. ..... 428/336; 313/509; 428/433; 428/690; 428/691; 428/702; 428/917

[58] Field of Search ..... 313/509; 428/690, 691, 428/433, 917, 336, 702

[56] References Cited

U.S. PATENT DOCUMENTS

| | | | |
|---|---|---|---|
| 2,894,854 | 7/1959 | MacIntyre, Jr. et al. | 313/509 |
| 2,989,636 | 6/1961 | Sieb | 313/509 X |
| 3,014,813 | 12/1961 | Bouchard et al. | 428/917 |
| 3,073,982 | 1/1963 | Buck, Jr. et al. | 313/509 |
| 3,104,339 | 9/1963 | Koury | 313/509 X |
| 3,107,178 | 10/1963 | Rindone | 428/690 X |
| 3,143,682 | 8/1964 | Clarke et al. | 313/509 |
| 3,201,633 | 8/1965 | Sieb | 428/433 X |
| 3,205,393 | 9/1965 | Mash | 313/509 |
| 3,283,194 | 11/1966 | Rulon | 313/509 |
| 4,394,601 | 7/1983 | Takeda et al. | 313/509 |
| 4,418,118 | 11/1983 | Lindors | 428/698 |
| 4,547,703 | 10/1985 | Fujita et al. | 428/690 |

FOREIGN PATENT DOCUMENTS 93289 7/1981 Japan .

*Primary Examiner*—George F. Lesmes
*Assistant Examiner*—William M. Atkinson
*Attorney, Agent, or Firm*—Stevens, Davis, Miller & Mosher

[57] ABSTRACT

The development of a dielectric thin-film which is high (140 MV/cm or above) in product of dielectric constant $\epsilon_i$ and dielectric breakdown field strength $E_{ib}$ is essential for realizing an EL element which can operate stably at a low voltage. Such dielectric film is also required which can withstand heat treatments at high temperatures above 500° C. and is proof against clouding and in which the electrical breakdown caused by a minute fault produced in the process of film formation is self-healed. A film material which satisfies all of these requirements could be obtained from a $TiO_2$-BaO based composition by partially substituting the position of Ti with Sn, Zr or Hf and also partially substituting the position of Ba with Ca or Mg. By using these dielectric films, it is possible to obtain a low-voltage drive thin-film electroluminescent element which are high in production yield and reliability.

11 Claims, 1 Drawing Figure

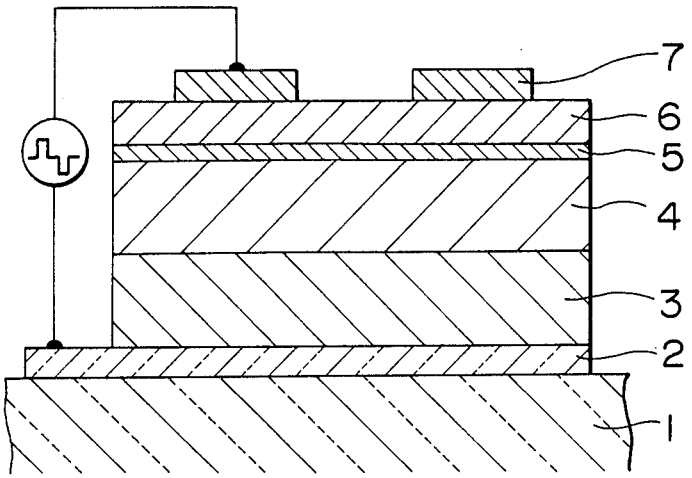
7
6
5
4
3
2
1

THIN-FILM ELECTROLUMINESCENT ELEMENT

TECHNICAL FIELD

The present invention relates to an electroluminescent element, and more particularly to a thin-film electroluminescent element which is actuated in an AC field. Such electroluminescent element has specific characteristics that enable the realization of plate displays, and it is especially suited for adaptation to character and graphic terminal displays for personal computers, etc. Therefore, such elements can be widely applied to the field of office automation systems.

BACKGROUND ART

Generally, an electroluminescent element (hereinafter abbreviated as EL element) which emits light upon application of an AC field has a structure in which a filmy layer of a dielectric is provided on one side or both sides of a thin layer of an electroluminescent phosphor and these laminate layers are sandwiched by two electrode layers. The phosphor layer used in such element is basically composed of such material as ZnS, ZnSe or $ZnF_2$ doped Mn or a rare-earth fluoride as a luminescent center in said base material. A ZnS phosphor element using Mn as a luminescent center is capable of providing a luminance of up to about 3,500–5,000 $Cd/m^2$ by the application of an AC voltage with a frequency of 5 kHz.

Typical examples of dielectric materials used in said element are $Y_2O_3$, $SiO_2$, $Si_3N_4$, $Al_2O_3$ and $Ta_2O_5$. The thickness of the ZnS layer is about 5,000 to 7,000 Å and that of the dielectric layer is about 4,000 to 8,000 Å.

In the case of AC drive, the voltage applied to the element is divided to the ZnS layer and the dielectric layer. Since the EL element is structurally equivalent to a series connection of two capacitors, there holds the relation of $\epsilon_i V_i/t_i = \epsilon_z V_z/t_z$ ($\epsilon$: dielectric constant; V: voltage applied; t: thickness; suffix i: indicating dielectric; suffix z: indicating ZnS), and thus each divided voltage is reversely proportional to the dielectric constant if $t_i = t_z$. In said dielectrics such as $Y_2O_3$, $\epsilon_i$ is about 4 to 25 and $\epsilon_z$ of ZnS is about 9, so that only about 30 to 70% of the whole applied voltage is given to the ZnS layer. In such elements, therefore, a high voltage above 200 V must be applied by a pulse drive of several kHz. Such high voltage gives a great deal of load to the drive circuit and necessitates a specific high-voltage withstanding drive IC, which leads to the increased production cost of the element.

A discussion is here made on what characteristics the dielectric layer is required to have for reducing the drive voltage. From the above-shown relation concerning voltage division, it is noted that the $\epsilon_i$ to $t_i$ ratio ($\epsilon_i/t_i$) must be great. After the start of emission of light, any increment of applied voltage is given to the dielectric layer, so that $V_{ib}$ (dielectric breakdown voltage of the dielectric layer) must be also high for giving an excellent dielectric film. Therefore, the figure of merit $\gamma$ of the dielectric layer is defined as follows:

$$\gamma = \epsilon_i V_{ib}/t_i = \epsilon_i E_{ib}$$

($E_{ib}$: dielectric breakdown field strength of the dielectric film)

As noted from the above equation, $\gamma$ is proportional to the electric charge accumulated per unit area of the dielectric layer when dielectric breakdown occurs. The greater the value of $\gamma$, the more stably can be conducted the low-voltage drive. This can be attributed to the following fact. In two EL elements which are same in phosphor layer thickness and dielectric layer thickness but different in properties of dielectric layer (for example, the dielectric layer in one of the elements has the properties of $\epsilon_i = 100$, $E_{ib} = 1 \times 10^6$ V/cm and $\gamma = 100 \times 10^6$ V/cm while the dielectric layer in another element has the properties of $\epsilon_i = 50$, $E_{ib} = 3 \times 10^6$ V/cm and $\gamma = 150 \times 10^6$ V/cm), naturally the former element can start to emit at a lower voltage than the latter element as they have the same thickness dielectric layer. However, in the latter element where $\epsilon_i = 50$ and $E_{ib} = 3 \times 10^6$ V/cm, if it is equalized to the former element in breakdown strength, its layer thickness can be reduced to $\frac{1}{3}$. Consequently, its dielectric capacity is trebled, boosting $\epsilon_1$ to 150. Therefore, a greater figure of merit allows the production of an element which emits light at a lower voltage, regardless of $\epsilon_i$. The greater the value of $\gamma$, the better, but practically, it is desirable that $\gamma$ is about 10 times the value of $14 \times 10^6$ V/cm that is obtained by substituting $\epsilon_z = 9$ and $E_{zb} = 1.6 \times 10^6$ V/cm of ZnS for $\epsilon_i$ and $E_{ib}$ in the above-shown formula and used as a standard value for low-voltage luminescence.

Conventional dielectric films are small in their figure of merit, which is about $50 \times 10^6$ V/cm in the case of $Y_2O_3$, about $30 \times 10^6$ V/cm in the case of $Al_2O_3$ and about $70 \times 106$ V/cm in the case of $Si_3N_4$, and thus they are not suited for low-voltage luminescence.

Recently, proposals have been made for use of a thin film mainly composed of $PbTiO_3$, $Pb(Ti_{1-x}Zr_x)O_3$ or like substance having a high dielectric constant as a dielectric layer in an electroluminescent element. These substances are high in $\epsilon_i$ which is over 150, but they are low in $E_{ib}$ which is on the order of $5 \times 10^5$ V/cm, so that when using these substances, it is required to greatly increase the film thickness in comparison with the conventional dielectric materials. To guarantee the reliability of the element produced, it is required that the dielectric film have a thickness greater than 15,000 Å, for 6,000 Å in thickness of ZnS film. Generally, where said substances are used, the grains in the film tend to grow to cause clouding of the film because of large film thickness and high substrate temperature at the time of formation of the film. In an X-Y matric display using such clouded film, light is emitted even from the non-luminescent segments as the light from the other segments is scattered, resulting in a degraded image quality.

The present inventors had already proposed an EL element using a dielectric film chiefly composed of $SrTiO_3$, which dielectric film is high in both $E_{ib}$ and the product of $E_{ib}$ and $\epsilon_i$, proof against clouding and suited for low-voltage drive. For instance, there had been obtained an $SrTiO_3$ dielectric film in which $\epsilon_i = 140$ and $E_{ib} = 1.5$ MV/cm, the product thereof being greater than that of a $BaTiO_3$ film ($10 \leqq \epsilon_i \leqq 40$, $E_{ib}$ up to 2 MV/cm). Reduction of driving voltage is desirable to improve reliability and production cost of the drive circuits, but no sufficient technical breakthrough has been attained in this regard. In order to increase the luminance of the phosphor layer, this layer is subjected to a heat treatment after formation of the film, but in case a dielectric layer is present beneath said phosphor layer, the dielectric layer also undergoes the heat treatment. Consequently, if the dielectric layer thickness is greater than about 0.5 μm, certain fault is found to take place in the dielectric film, affecting the breakdown strength of the element. Also, the mode of dielectric breakdown tends to become propagating and is unable to self-heal.

The present invention is intended to obtain a dielectric film which is better suited for low-voltage drive and also has higher reliability than said $SrTiO_3$ dielectric film. It is especially envisaged in this invention to obtain a dielectric film of the type whose dielectric breakdown, if any, is restricted to self heal, keeping free of propagating breakdown which can be a fatal defect for an EL element.

BRIEF DESCRIPTION OF THE DRAWING

The drawing is a schematic sectional view of a thin-film electroluminescent element in an embodiment of this invention.

In the drawing, numeral 1 designates a glass substrate, 2 a transparent electrode, 3 a dielectric film, 4 a ZnS-Mn phosphor film, 5 a $Ta_2O_5$ film, 6 a $PbNb_2O_6$ film, and 7 an Al electrode.

BEST MODE FOR CARRYING OUT THE INVENTION

The present invention provides a thin-film electroluminescent element comprising a filmy phosphor layer, a filmy dielectric layer provided on at least one side of said phosphor layer, and two electrode layers at least one of which is pervious to light, said electrode layers being so arranged as to apply a voltage to said phosphor and dielectric layers, wherein said dielectric layer is essentially of a composition represented by the formula:

$$x(Ti_{1-y}A_yO_2)-(1-x)(Ba_{1-z}M_zO)$$

wherein $0.4 \leqq x \leqq 0.8$, $0<y<1$, $0 \leqq z<1$, A is at least one element selected from Zr, Hf and Sn, and M is at least one element selected from Mg and Ca.

The present invention features a novel composition of dielectric film used in the conventional thin-film luminescent elements. According to the present invention, a dielectric film having $\epsilon_i$ above 50 and $E_{ib}$ of $3\times10^6$ V/cm could be obtained by substituting the position of Ti in a $TiO_2$-BaO system with Zr, Hf or Sn and further substituting the position of Ba with Ca or Mg as described above. The film was formed by a magnetron RF sputtering method using sintered ceramic targets prepared for the respective compositions. The results of chemical analysis of the formed film showed substantial agreement of its composition with that of the target.

The dielectric film of said composition and structure has excellent properties for use in an EL element in comparison with conventional dielectric films. For instance, in the case of a BaO-$TiO_2$-$SnO_2$ system, the produced film shows higher $\epsilon_i$ and $E_{ib}$ than the conventional $BaTiO_3$ or $SrTiO_3$ film, and accordingly, the value of $\epsilon_i \times E_{ib}$ is greater than those in said conventional films. Further, the film according to this invention shows no trace of clouding due to the growth of grains and is transparent, so that when it is used as the dielectric layer in an EL element, there can be obtained an EL element with excellent image quality. It was also found that the substitution of Ti with Zr or Hf can provide as high $\epsilon_i$ or $E_{ib}$ as in the case of substitution with Sn and enables a characteristic heat-resistant dielectric film to be obtained. Cracking of the film in the process of heat treatment leads to a reduction of reliability of the produced EL element because such cracking could cause disconnection of the matrix electrode, though such is very rare. Therefore, use of a multiple-component dielectric film as shown here enables the high-yield production of high-reliability EL elements free of cracks in the dielectric layer.

The present invention will be further described below by way of the embodiments thereof with reference to the accompanying drawing.

As illustrated in the drawing, on a glass substrate 1 provided with an ITO transparent electrode 2, a dielectric film 3 having a composition of $x(Ti_{0.8}Sn_{0.2}O_2)$—$(1-x)$BaO was deposited to a thickness of 5,000 Å by magnetron RF sputtering. The sputtering of said composition was made by changing the value of x: 0.4, 0.5, 0.6, 0.7 and 0.8. A mixed gas of $O_2$ and Ar (partial pressure of $O_2$: 25%) was used as the sputtering gas, the gas pressure during sputtering being 0.8 Pa. Used as the target was a ceramic plate prepared by mixing ingredient powders in said composition and sintering the mixture at 1,400° C. The substrate temperature was 400° C. The produced films with the respective compositions (differing only in the value of x in the above-shown composition) were all transparent and showed no cloudiness. At the point where the dielectric film 3 was formed, the values of $\epsilon_i$ and $E_{ib}$ of the film of each composition were checked. Then ZnS and Mn were simultaneously deposited on the dielectric film by electron-beam deposition to form a ZnS-Mn phosphor layer 4 with a thickness of 5,000 Å, and this layer was subjected to a heat treatment in vacuo at 600° C. for one hour. For protection of said ZnS-Mn layer, a 400 Å thick $Ta_2O_5$ film 5 was further formed on said ZnS-Mn layer by electron-beam deposition. On said $Ta_2O_5$ film 5 was additionally deposited a $PbNb_2O_6$ film 6 to a thickness of 1,000 Å by magnetron RF sputtering. An Ar mixed gas containing 25% of $O_2$ was used as the sputtering gas. The sputtering gas pressure was 3 Pa. A ceramic of $PbNb_2O_6$ was used as the target and the substrate temperature was controlled to 380° C. Finally, a 1,000 Å thick Al film 7 was formed as a top electrode by electric resistance heating deposition to complete an EL element.

Each of the thus formed EL elements was driven by an AC pulse with a repetitive frequency of 5 kHz to determine the voltage-luminance characteristic. Table 1 shows the electrical properties and luminous characteristics of the elements with the respective dielectric compositions (differing in value of x).

TABLE 1

| No. | x | $\epsilon_i$ | $E_{ib}$ (V/cm) | $\epsilon_i \times E_{ib}$ (V/cm) | Luminance (Cd/m²)/ applied voltage (V) |
|---|---|---|---|---|---|
| 1 | 0.4 | 60 | $3.0\times10^6$ | $180\times10^6$ | 3500/120 |
| 2 | 0.5 | 70 | $3.0\times10^6$ | $210\times10^6$ | 3500/110 |
| 3 | 0.6 | 55 | $3.2\times10^6$ | $176\times10^6$ | 3500/125 |
| 4 | 0.7 | 40 | $3.5\times10^6$ | $140\times10^6$ | 3450/135 |
| 5 | 0.8 | 35 | $3.5\times10^6$ | $112\times10^6$ | 3400/140 |

The voltage at which the saturation brightness of 3,400 to 3,500 Cd/m² is reached is given in the table as a measure of luminous characteristics. As seen from the table, the dielectric constant is maximized and also the value of $\epsilon_i \times E_{ib}$ becomes largest when x is 0.5. What is especially noteworthy in this system is that the dielectric breakdown field strength $E_{ib}$ is above $3\times10^6$ V/cm, which is far greater than that in the case of $SrTiO_3$, and that the mode of dielectric breakdown is of the self-healing type. Also, some of the obtained elements showed a dielectric constant above 100 when the heat treatment after deposition was conducted at 600° C. for one hour. From the above-shown dependency of $\epsilon_i$ and $E_{ib}$ on the compositional change (in x), it was found that the produced films are far higher in $E_{ib}$ than that of $SrTiO_3$ and has substantially the same figure of merit as that of $SrTiO_3$ when x is between 0.4 and 0.8. Being high in $E_{ib}$ is an essential factor for improving the reliability of the thin-film electroluminescent element. As regards the luminous characteristics, the voltage that provides the saturation brightness of 3,400–3,500 $Cd/m^2$ is minimized (110 V) when x=0.5, indicating low-voltage drivability of the element. Also, said voltage is below 140 V even when x is in the range of 0.4 to 0.8, and thus low-voltage drive is possible.

Considering the above-shown results synthetically, it is learned that by using a composition represented by the formula: $x(Ti_{0.8}Sn_{0.2}O_2)$—$(1-x)BaO$, with x in the formula being defined as $0.4 \leqq x \leqq 0.8$, it is possible to obtain a film more excellent than the conventional $SrTiO_3$ or $BaTiO_3$ film as a dielectric film for a low-voltage drive type EL element.

We will now describe the case where the amount of partial substitution of Ti with Sn is further changed in said $x(Ti_{0.8}Sn_{0.2}O_2)$—$(1-x)BaO$ system by defining x to 0.5 at which the most excellent film properties are obtained. The amount of substitution with Sn was varied from 0 to 0.4. The method of evaluation of dielectric film, the construction and preparing conditions of the element and the conditions for determination of luminous characteristics are the same as in the case of said $Ti_{0.8}Sn_{0.2}O_2$—BaO system. Table 2 shows the results obtained when substituting Sn for the position of Ti. In the table, there was given a new item indicating the percentage of cracking of the dielectric film at the time of annealing of the ZnS-Mn phosphor layer 4 formed on the dielectric film 3 (the percentage of cracking was calculated from the number of samples which were cracked in 10 pieces of samples tested). There was also given a column for qualitatively showing whether the state of dielectric breakdown is self-healed or not by observing the mode of dielectric breakdown after determination of dielectric breakdown field strength.

TABLE 2

| No. | y | $\epsilon_i$ | $E_{ib}$ (V/cm) | $\epsilon_i \times E_{ib}$ (V/cm) | Percentage of cracked samples (%) | Dielectric breakdown was: Self-healed (o), Not self-healed (x) |
|---|---|---|---|---|---|---|
| 6 | 0 | 63 | $1.5 \times 10^6$ | $95 \times 10^6$ | 100 | x |
| 7 | 0.1 | 80 | $1.6 \times 10^6$ | $128 \times 10^6$ | o | o |
| 8 | 0.2 | 70 | $3.3 \times 10^6$ | $231 \times 10^6$ | o | o |
| 9 | 0.3 | 48 | $3 \times 10^6$ | $144 \times 10^6$ | o | o |
| 10 | 0.4 | 30 | $3 \times 10^6$ | $90 \times 10^6$ | o | o |

As seen from Table 2, both $\epsilon_i$ and $E_{ib}$ tend to increase with the partial substitution of Ti with Sn. Thus, when Ti is substituted with Sn to a degree where y is 0.3 or below, there can be obtained a greater figure of merit than that obtainable with a $0.5TiO_2-0.5BaO$ film. Especially, the figure of merit of $\epsilon_i \times E_{ib}$ is maximized when the substitution rate y of Sn is 0.2 or thereabout. Thus, in this region of Sn substitution rate, the high-yield production of low-voltage drive EL element proof against cracking at the time of annealing is possible. Also, when y (Sn substitution rate) was 0.1, 0.2 and 0.3, the dielectric constant of the dielectric film after annealing was 150, 130 and 100, respectively, indicating a further reduction of drive voltage for the EL element by the Sn substitution for Ti in said range.

The effect of similar substitution for Ti with Zr and Hf was examined in the same way as in the case of substitution with Sn. It was found that, in this case, the value of $\epsilon_i \times E_{ib}$ is maximized and also the film becomes most resistant to cracking when y is 0.2 or therearound as in the case of Sn. It is especially noteworthy in the case of Zr and Hf that the range of substitution rate (y) that provides a large figure of merit is wide, and it was confirmed that even when y was 0.5, the produced dielectric film could well serve for a low-voltage drive EL element. For instance, in the case of $0.5(Ti_{0.7}Zr_{0.3}O_2)-0.5BaO$, $\epsilon_i$ was 60 and $E_{ib}$ was $2.5 \times 10^6$ V/cm, and further the mode of dielectric breakdown was the self-healing type. Also, in the case of $0.5(Ti_{0.5}Zr_{0.5}O_2)-0.5BaO$, $\epsilon_i=30$ and $E_{ib}=3 \times 10^6$ V/cm, and in the case of $0.5(Ti_{0.6}Hf_{0.5}O_2)-0.5BaO$, $\epsilon_i=35$ and $E_{ib}=3 \times 10^6$ V/cm.

It is needless to say that an excellent low-voltage drive EL element can be obtained by properly combining the substituting elements Sn, Zr and Hf for the position of Ti.

The results obtained from substitution for the position of Ba with Mg and Ca are shown below.

The method of evaluation of the dielectric film, the structure and preparing conditions of the element and the luminous characteristic determining conditions were the same as in the case of said $0.5Ti_{1-y}Sn_yO_2-0.5BaO$ system.

Table 3 shows the results obtained from Mg substitution for the position of Ba.

TABLE 3

| No. | Valve of z in $0.5\ Ti_{0.8}Sn_{0.1}O_2$-$0.5(Ba_{1-z}Mg_zO)$ | $\epsilon_i$ | $E_{ib}$ (V/cm) | $\epsilon_i \times E_{ib}$ (V/cm) | Percentage of cracking |
|---|---|---|---|---|---|
| 11 | 0 | 80 | $1.6 \times 10^6$ | $128 \times 10^6$ | o |
| 12 | 0.1 | 75 | $1.8 \times 10^6$ | $135 \times 10^6$ | o |
| 13 | 0.2 | 70 | $2.0 \times 10^6$ | $140 \times 10^6$ | o |
| 14 | 0.3 | 65 | $2.5 \times 10^6$ | $163 \times 10^6$ | o |
| 15 | 0.4 | 50 | $2.8 \times 10^6$ | $140 \times 10^6$ | o |
| 16 | 0.6 | 20 | $3.0 \times 10^6$ | $60 \times 10^6$ | o |

As seen from Table 3, partial substitution of Ba with Mg produces and decreasing tendency of $\epsilon_i$ while causing an increase of $E_{ib}$. Thus, in the range of about 10 to 30% substitution for Ba with Mg, the produced film is improved in the figure of merit over the non-substituted film. Also, no cracking was caused by the substitution of Ba with Mg. However, when the Mg substitution rate exceeds 60%, the dielectric constant is reduced to the order of 20 and the figure of merit falls below the level of $100 \times 10^6$ V/cm suited for low-voltage luminescence (about 7 times the figure of merit provided by ZnS). Therefore, the appropriate substitution rate of Mg for Ba would be less than 40%. In this range, it is possible to produce, in a high yield, a low-voltage drive EL element having no risk of cracking at the time of annealing.

The case of Ca substitution in completely the same manner as in the case of Mg described above was also examined. In this case, there was observed the same tendency concerning $\epsilon_i$ and $E_{ib}$ as in the case of Mg, and also no crack was seen in the produced film. The optimal range of Ca substitution rate was determined to be less than 30%; any greater substitution rate drops the figure of merit below $100 \times 10^6$ V/cm and also makes the film prone to clouding. In the film with a composition of $0.5(Ti_{0.9}SN_{0.1}O_2)$—$0.5(Ba_{0.7}Ca_{0.3}O)$, $\epsilon_i=60$, $E_{ib}=2.3\times10^6$ V/cm, and $\epsilon_i\times E_{ib}=138\times10^6$ V/cm. It was also found that the produced dielectric film comes to show a self-healing type dielectric breakdown when the position of Ti is substituted with Sn by a factor of about 0.1 to 0.3.

As described above, by use of the compositions according to this invention, there can be obtained a dielectric film which is proof against cracking and is characteristically high in $\epsilon_i$ and $E_{ib}$ and hence also high in the figure of merit. Further, when Ti in the composition is substituted with Sn, Zr or Hf, dielectric breakdown of the film is rendered to be a self-healing type.

It is of course possible to adopt a four-component system incorporating said substitutions within the specified range of substitution rate for the purpose of combining the advantages of the respective substituting elements (Sn, Zr or Hf for Ti, and Mg or Ca for Ba) in the basis composition of $TiO_2$-BaO.

INDUSTRIAL APPLICABILITY

As described above, according to the present invention, the filmy dielectric layer of a thin-film electroluminescent element is composed of a dielectric having a composition of $x(Ti_{1-y}A_yO_2)$—$(1-x)BaO$ which is high in figure of merit and resistant to cracking and whose dielectric breakdown tends to self-heal, so that it is possible to obtain a low-voltage drive type electroluminescent element with high image quality and reliability in a high yield. This is of great industrial value from the aspects of improvement of reliability and production cost of drive circuits.

What is claimed is:

1. A thin-film electroluminescent element comprising a filmy phosphor layer, a filmy dielectric layer having high optical transparency without an optical scattering property and a thickness less than about 0.5 micrometer formed by a sputtering method on at least one side of said phosphor layer, and two electrode layers at least one of which is pervious to light, said electrode layers being so arranged as to apply a voltage to said phosphor and dielectric layers, wherein the essential composition of said dielectric layer is expressed by the following formula:

$$x(Ti_{1-y}A_yO_2)—(1-x)(Ba_{1-z}M_zO)$$

wherein x, y and z are the numbers defined as: $0.4\leqq x\leqq0.8$, $0.1\leqq y<1$, and $0\leqq z<0.6$, and A is at least one element selected from the group consisting of Zr, Hf and Sn, and M is at least one element selected from the group consisting of Mg and Ca.

2. A thin-film electroluminescent element according to claim 1, wherein in the compositional formula of the essential components of the dielectric layer, A is Zr or Hf and y is a range defined as: $0.1\leqq y\leqq0.5$.

3. A thin-film electroluminescent element according to claim 1, wherein in the, compositional formula of the essential components of the dielectric layer, A is Sn and y is a range defined as: $0.1\leqq y\leqq0.3$.

4. A thin-film electroluminescent element according to claim 1, wherein in the compositional formula of the essential components of the dielectric layer, M is Mg and z is a range defined as: $0.\leqq z\leqq0.4$.

5. A thin-film electroluminescent element according to claim 1, wherein in the compositional formula of the essential components of the dielectric layer, M is Ca and z is a range defined as: $0.1\leqq z\leqq0.3$.

6. A thin-film electroluminescent element according to claim 1, wherein said filmy dielectric layer does not have an optical scattering property at temperatures below 600° C.

7. A thin-film electroluminsecent element comprising a filmy phosphor layer, a filmy dielectric layer provided on at least one side of said phosphor layer, and two electrode layers at least one of which is pervious to light, the dielectric layer having a thickness less than about 0.5 micrometer, said electrode layers being so arranged as to apply a voltage to said phosphor and dielectric layers, wherein the essential composition of said dielectric layer is formed by a sputtering method, and is expressed by the following formula:

$$x(Ti_{1-y}Sn_yO_2)—(1—x)BaO$$

wherein x and y are the numbers defined as: $0.4\leqq x\leqq0.8$ and $0.1\leqq y<1$.

8. A thin-film electroluminescent element according to claim 7, wherein in the compositional formula of the essential components of the dielectric layer, y is a range defined as $0.1\leqq y\leqq0.3$.

9. A thin-film electroluminescent element according to claim 7, wherein in the compositional formula of the essential components of the dielectric layer, $y=0.2$.

10. A thin-film electroluminescent element comprising a filmy phosphor layer, a filmy dielectric layer provided on at least one side of said phosphor layer, and two electrode layers at least one of which is pervious to light, the dielectric layer having a thickness less than about 0.5 micrometer, said electrode layers being so arranged as to apply a voltage to said phosphor and dielectric layers, wherein the essential composition of said dielectric layer is formed by a sputtering method, and is expressed by the following formula:

$$x(Ti_{1-y}Sn_yO_2)—(1-x)Ba_{1-z}Mg_zO$$

wherein x, y and z are thenumbers defined as: $0.4\leqq x\leqq0.8$, $0.1\leqq y<1$, $0<z<0.6$.

11. A thin-film electroluminescent element according to claim 10, wherein in the compositional formula of the essential components of the dielectric layer, z is a range defined as: $0<z\leqq0.4$.

* * * * *